US010724121B2

(12) United States Patent
Kirchheiner et al.

(10) Patent No.: US 10,724,121 B2
(45) **Date of Patent: *Jul. 28, 2020**

(54) THERMOSTABLE AND CORROSION-RESISTANT CAST NICKEL-CHROMIUM ALLOY

(71) Applicant: SCHMIDT + CLEMENS GMBH + CO. KG, Lindlar (DE)

(72) Inventors: Rolf Kirchheiner, Iserlohn (DE); Dietlinde Jakobi, Köln (DE); Petra Becker, Köln (DE); Ricky Durham, Köln (DE)

(73) Assignee: Schmidt + Clemens GmbH + Co. KG, Lindlar (DE)

( * ) Notice: Subject to any disclaimer, the term of this patent is extended or adjusted under 35 U.S.C. 154(b) by 43 days.

This patent is subject to a terminal disclaimer.

(21) Appl. No.: 16/055,645

(22) Filed: Aug. 6, 2018

(65) Prior Publication Data

US 2019/0106770 A1 Apr. 11, 2019

Related U.S. Application Data

(63) Continuation of application No. 12/169,229, filed on Jul. 8, 2008, now Pat. No. 10,041,152, which is a continuation of application No. 10/945,859, filed on Sep. 21, 2004, now abandoned, which is a continuation of application No. PCT/EP2004/000504, filed on Jan. 22, 2004.

(30) Foreign Application Priority Data

Jan. 25, 2003 (DE) ..... 103 02 989

(51) Int. Cl.
*C22C 19/05* (2006.01)

(52) U.S. Cl.
CPC ..... *C22C 19/053* (2013.01); *C22C 19/055* (2013.01); *C22C 19/056* (2013.01); *C22C 19/058* (2013.01)

(58) Field of Classification Search
CPC .... C22C 19/055; C22C 19/053; C22C 19/052
See application file for complete search history.

(56) References Cited

U.S. PATENT DOCUMENTS

| | | | |
|---|---|---|---|
| 3,865,581 A | 2/1975 | Sekino | |
| 4,039,330 A | 8/1977 | Shaw | |
| 4,444,589 A | 4/1984 | Sugitani et al. | |
| 4,671,931 A | 6/1987 | Herchenroeder et al. | |
| 4,787,945 A | 11/1988 | Smith | |
| 4,832,912 A | 5/1989 | Yabuki et al. | |
| 5,306,358 A | 4/1994 | Lai et al. | |
| 5,403,547 A | 4/1995 | Smith et al. | |
| 5,980,821 A | 11/1999 | Brill | |
| 5,997,809 A | 12/1999 | Smith et al. | |
| 6,623,869 B1 | 9/2003 | Nishiyama et al. | |
| 10,041,152 B2 * | 8/2018 | Kirchheiner | C22C 19/053 |
| 2002/0004017 A1 | 1/2002 | Quayle | |

FOREIGN PATENT DOCUMENTS

| | | |
|---|---|---|
| DE | 3880114 T2 | 10/1993 |
| EP | 0549286 A | 6/1993 |
| EP | 0611938 A | 8/1994 |
| EP | 1065290 A1 | 1/2001 |
| JP | 59074256 A | 4/1984 |
| JP | S5974266 A | 4/1984 |
| JP | H01252750 A | 10/1989 |
| JP | 2002003970 A | 1/2002 |
| JP | 2002235136 A | 8/2002 |

OTHER PUBLICATIONS

Davis et al, Properties and Selection: Nonferrous Alloys and Special-Purpose Materials, vol. 2, ASM Handbook 1096 (10th ed, 1990).
International Search Report dated Jan. 24, 2014 for related Austrian Patent Application No. UAE/P/396/2005.
Davis el al., The ASM Handbook, Specific Metals and Alloys, vol. 2, pp. 727-728, ASM Handbook 1096 (10th ed, 1990).
ASM International, Materials Park, Ohio, ASM Speciality Handbook: Nickel, Cobalt, and Their Alloys, p. 17, Dec. 2000.
Huebner, Ulrich; "Nickel alloys". Expert Verlag, New York, 1998 XP002277481, p. 16-23.
Agarwal D. C. et al: "High-Temperature-Strength Nickel Alloy" Advanced Materials and Processes, American Society for Metals, Metals Park, OH, US, vol. 158, No. 4, Oct. 2000. pp. 31-34, XP008014854, ISSN: 0882-7958.
Brili U: Eigenschaften und Einsatzgebiete der neuen warmfesten Legierung Nicrofer 6025 HT, Stahl. Verl. Stahleisen, Düsseldorf, DE, vol. 3. 1994. pp. 32-35 XP008014860 ISSN: 0941-0821.
W. Wegst, C.W.; Key to steel; Verlag Stahlschlussel Wegst Gmbh; Marbach Germany; www.stahlschluessei.de; ISBN 3-922599-17-6; 2001, 4 pages.

* cited by examiner

*Primary Examiner* — Jessee R Roe
(74) *Attorney, Agent, or Firm* — Howard IP Law Group, PC

(57) ABSTRACT

A nickel-chromium casting alloy comprising, in weight percent, up to 0.8% of carbon, up to 1% of silicon, up to 0.2% of manganese, 15 to 40% of chromium, 0.5 to 13% of iron, 1.5 to 7% of aluminum, up to 2.5% of niobium, up to 1.5% of titanium, 0.01 to 0.4% of zirconium, up to 0.06% of nitrogen, up to 12% of cobalt, up to 5% of molybdenum, up to 6% of tungsten and from 0.01 to 0.1% of yttrium, remainder nickel, has a high resistance to carburization and oxidation even at temperatures of over 1130° C. in a carburizing and oxidizing atmosphere, as well as a high thermal stability, in particular creep rupture strength.

17 Claims, 16 Drawing Sheets

THERMOSTABLE AND CORROSION-RESISTANT CAST NICKEL-CHROMIUM ALLOY

CROSS-REFERENCES TO RELATED APPLICATIONS

The present application is a continuation of U.S. application Ser. No. 12/169,229, filed Jul. 8, 2008, now U.S. Pat. No. 10,041,152, which is in turn a continuation of U.S. application Ser. No. 10/945,859, filed Sep. 21, 2004, now abandoned, which in turn is a continuation of prior filed PCT International Application No. PCT/EP2004/000504, filed Jan. 22, 2004, which claims the priority of German Patent Application, Serial No. 103 02 989.3, filed Jan. 25, 2003, the entire contents of each of which are incorporated herein by reference for all purposes.

BACKGROUND OF THE INVENTION

The present invention relates to a thermostable and corrosion-resistant cast nickel-chromium alloy.

Nothing in the following discussion of the state of the art is to be construed as an admission of prior art.

High-temperature processes, for example those used in the petrochemical industry, require materials which are not only heat-resistant but also sufficiently corrosion-resistant and in particular are able to withstand the loads imposed by hot product and combustion gases. For example, the tube coils used in cracking and reformer furnaces are externally exposed to strongly oxidizing combustion gases with a temperature of up to 1100° C. and above, whereas a strongly carburizing atmosphere at temperatures of up to 1100° C. prevails in the interior of cracking tubes, and a weakly carburizing, differently oxidizing atmosphere prevails in the interior of reformer tubes at temperatures of up to 900° C. and a high pressure. Moreover, contact with the hot combustion gases leads to nitriding of the tube material and to the formation of a layer of scale, which is associated with an increase in the external diameter of the tube by a few percent and a reduction in the wall thickness by up to 10%.

By contrast, the carburizing atmosphere inside the tube causes carbon to diffuse into the tube material, where, at temperatures of over 900° C., it leads to the formation of carbides, such as $M_{23}C_6$, and, with increasing carburization, to the formation of the carbon-rich carbide $M_7C_3$. The consequence of this is internal stresses resulting from the increase in volume associated with the carbide formation or transformation and a decrease in the strength and ductility of the tube material. Furthermore, graphite or dissociation carbon may form in the interior of the tube material, which can, in combination with internal stresses, lead to the formation of cracks, which in turn cause more carbon to diffuse into the tube material.

Consequently, high-temperature processes require materials with a high creep strength or limiting rupture stress, microstructural stability and resistance to carburization and oxidation. This requirement is—within limits—satisfied by alloys which, in addition to iron, contain 20 to 35% of nickel, 20 to 25% of chromium and, to improve the resistance to carburization, up to 1.5% of silicon, such as for example the nickel-chromium steel alloy 35Ni25Cr-1.5Si, which is suitable for centrifugally cast tubes and is still resistant to oxidation and carburization even at temperatures of 1100° C. The high nickel content reduces the diffusion rate and the solubility of the carbon and therefore increases the resistance to carburization.

On account of their chromium content, at relatively high temperatures and under oxidizing conditions the alloys form a covering layer of $Cr_2O_3$, which acts as a barrier layer preventing the penetration of oxygen and carbon into the tube material beneath it. However, at temperatures over 1050° C., the $Cr_2O_3$ becomes volatile, and consequently the protective action of the covering layer is rapidly lost.

Under cracking conditions, carbon deposits are inevitably also formed on the tube inner wall and/or on the $Cr_2O_3$ covering layer, and at temperatures of over 1050° C. in the presence of carbon and steam, the chromium oxide is converted into chromium carbide. To reduce the associated adverse effect on the resistance to carburization, the carbon deposits in the tube have to be burnt from time to time with the aid of a steam/air mixture, and the operating temperatures generally have to be kept below 1050° C.

The resistance to carburization and oxidation is further put at risk by the limited creep rupture strength and ductility of the conventional nickel-chromium alloys, which lead to the formation of creep cracks in the chromium oxide covering layer and to the penetration of carbon and oxygen into the tube material via the cracks. In particular in the event of a cyclical temperature loading, covering layer cracks may form and also the covering layer may become partially detached.

Tests have revealed that microstructural phase reactions, in particular at higher silicon contents, for example of over 2.5%, evidently lead to a loss of ductility and to a reduction in the short-time strength.

It would therefore be desirable and advantageous to inhibit the damage mechanism of carburization—reduction in the creep rupture strength or limiting rupture stress—internal oxidation, with the further result of increased carburization and oxidation, and to provide an improved casting alloy which still has a reasonable service life even under extremely high operating temperatures in a carburizing and/or oxidizing atmosphere.

SUMMARY OF THE INVENTION

According to one aspect of the present invention, a nickel-chromium casting alloy having defined aluminum and yttrium contents and comprising, in weight percent,

| | |
|---|---|
| up to 0.8% | of carbon |
| up to 1% | of silicon |
| up to 0.2% | of manganese |
| 15 to 40% | of chromium |
| 0.5 to 13% | of iron |
| 1.5 to 7% | of aluminum |
| up to 2.5% | of niobium |
| up to 1.5% | of titanium |
| 0.01 to 0.4% | of zirconium |
| up to 0.06% | of nitrogen |
| up to 12% | of cobalt |
| up to 5% | of molybdenum |
| up to 6% | of tungsten |
| 0.01 to 0.1% | of yttrium |
| remainder nickel. | |

The total content of nickel, chromium and aluminum combined in the alloy should be from 80 to 90%.

It is preferable for the alloy, individually or in combination with one another, to contain at most 0.7% of carbon, up to 30% of chromium, up to 12% of iron, 2.2 to 6% of aluminum, 0.1 to 2.0% of niobium, 0.01 to 1.0% of titanium, up to 0.15% of zirconium and—to achieve a high creep rupture strength—up to 10% of cobalt, at least 3% of molybdenum and up to 5% of tungsten, for example 4 to 8% of cobalt, up to 4% of molybdenum and 2 to 4% of tungsten, if the high resistance to oxidation is not the primary factor. Therefore, depending on the loads encountered in the specific circumstances, the cobalt, molybdenum and tungsten contents have to be selected within the content limits specified by the invention.

An alloy comprising at most 0.7% of carbon, at most 0.2, more preferably at most 0.1% of silicon, up to 0.2% of manganese, 18 to 30% of chromium, 0.5 to 12% of iron, 2.2 to 5% of aluminum, 0.4 to 1.6% of niobium, 0.01 to 0.6% of titanium, 0.01 to 0.15% of zirconium, at most 0.6% of nitrogen, at most 10% of cobalt, and at most 5% of tungsten, is particularly suitable.

Optimum results can be achieved if, in each case individually or in combination with one another, the chromium content is at most 26.5%, the iron content is at most 11%, the aluminum content is from 3 to 6%, the titanium content is over 0.15%, the zirconium content is over 0.05%, the cobalt content is at least 0.2%, the tungsten content is over 0.05% and the yttrium content is 0.019 to 0.089%.

The high creep rupture strength of the alloy according to the invention, for example a service life of 2000 hours under a load of from 4 to 6 MPa and a temperature of 1200° C., guarantees that a continuous, securely bonded oxidic barrier layer is retained in the form of an $Al_2O_3$ layer which has the effect of preventing carburization and oxidation, results from the high aluminum content of the alloy and continues to top itself up or grow. As tests have shown, this layer comprises $\alpha$-$Al_2O_3$ and contains at most isolated spots of mixed oxides, which do not alter the essential nature of the $\alpha$-$Al_2O_3$ layer; at higher temperatures, in particular over 1050° C., in view of the rapidly decreasing stability of the $Cr_2O_3$ layer of conventional materials at these temperatures, is increasingly responsible for protecting the alloy according to the invention from carburization and oxidation. On the $Al_2O_3$ barrier layer, there may also—at least in part—be a covering layer of nickel oxide (NiO) and mixed oxides ($Ni(Cr,Al)_2O_4$), the condition and extent of which, however, is not of great significance, since the $Al_2O_3$ barrier layer below is responsible for protecting the alloy from oxidation and carburization. Cracks in the covering layer and the (partial) flaking of the covering layer which occurs at higher temperatures are therefore harmless.

To ensure that the $\alpha$-aluminum oxide layer is as pure as possible and substantially free of mixed oxides, the following condition should be satisfied:

$$9[\%\ Al] \geq [\%\ Cr].$$

On account of its high aluminum content, the microstructure of the alloy according to the invention, at over 4% of aluminum, inevitably contains $\gamma'$ phase, which has a strengthening action at low and medium temperatures but also reduces the ductility or elongation at break. In individual cases, therefore, it may be necessary to reach a compromise between ductility and resistance to oxidation/carburization which is oriented according to the intended use.

The barrier layer according to the invention comprising $\alpha$-$Al_2O_3$, which is the most stable $Al_2O_3$ modification, is able to withstand all oxygen concentrations.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
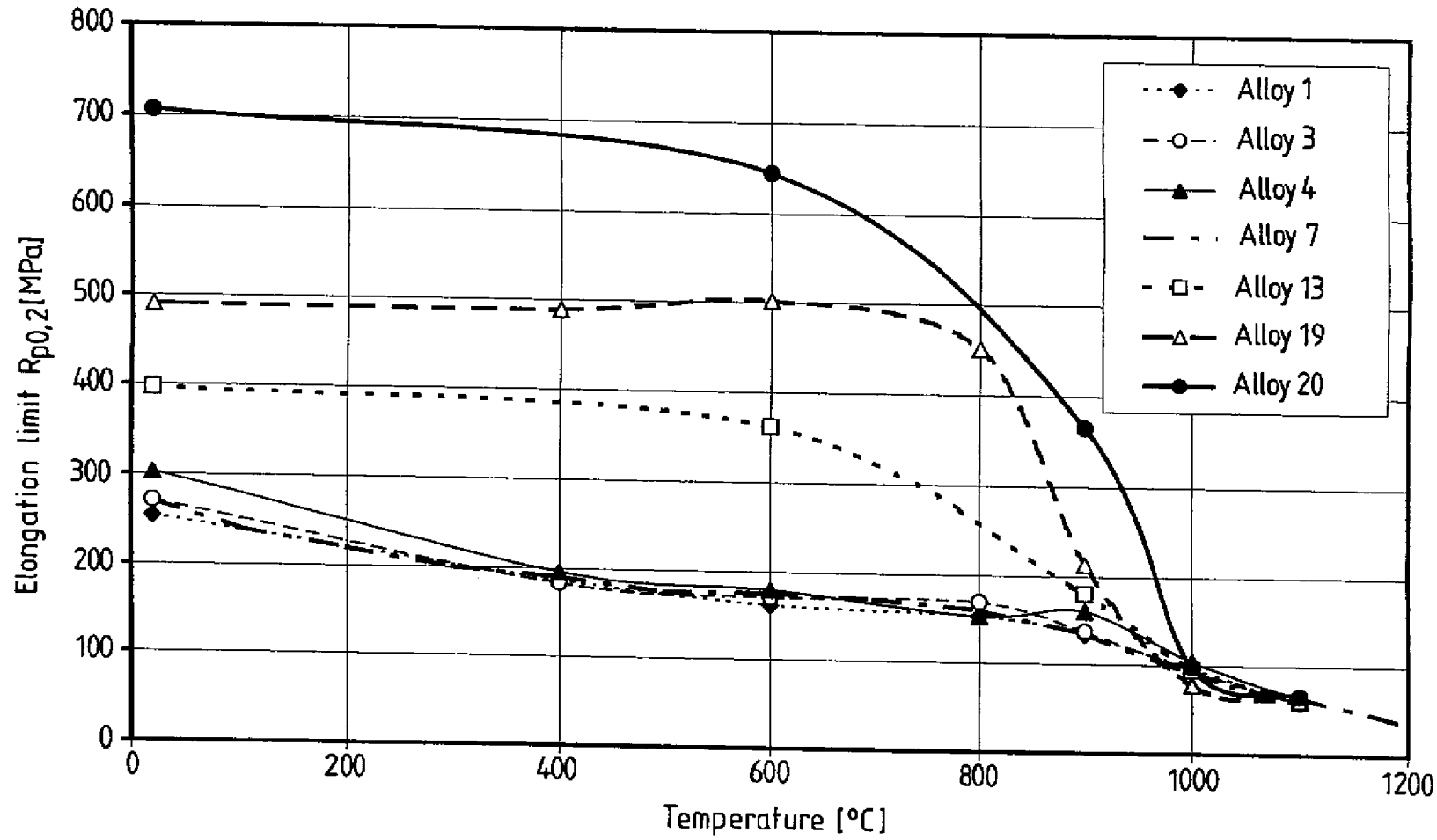
FIG. 1 shows a graphical illustration of various alloys, illustrating the elongation limit as a function of the temperature.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

The invention is explained in more detail below on the basis of exemplary embodiments and the seven comparative alloys 1 to 7 and nine alloys 8 to 26 according to the invention listed in the table below, and also the diagrams shown in FIGS. 1 to 16.

| Alloy | C | Si | Mn | P | S | Ni | Cr | Mo | Fe | V | W |
|---|---|---|---|---|---|---|---|---|---|---|---|

-continued

| | | | | | | | | | | | |
|---|---|---|---|---|---|---|---|---|---|---|---|
| 1 | 0.44 | 1.72 | 1.23 | 0.014 | 0.005 | 34.4 | 25.02 | 0.01 | 35.91 | 0.03 | 0.04 |
| 2 | 0.38 | 0.57 | 0.54 | 0.009 | 0.001 | 32.2 | 19.9 | <0.01 | remainder | 0.03 | <0.01 |
| | 0.52 | 2.20 | 1.64 | 0.025 | 0.013 | 36 | 26.52 | 0.33 | | 0.12 | 0.82 |
| 3 | 0.53 | 2.05 | 0.29 | 0.014 | 0.004 | 30.4 | 29.84 | 0.02 | 35.32 | 0.04 | 0.04 |
| 4 | 0.46 | 2.03 | 1.26 | 0.018 | 0.004 | 45.7 | 34.35 | 0.01 | 14.85 | 0.04 | 0.01 |
| 5 | 0.03 | n.d. | n.d. | n.d. | n.d. | 76.5 | n.d. | n.d. | 3.0 | n.d. | nd. |
| 6 | 0.09 | 2.13 | 1.14 | 0.017 | 0.004 | 38.1 | 26.02 | 0.01 | 33.25 | 0.03 | 0.04 |
| 7 | 0.20 | 0.25 | 0.05 | n.d. | n.d. | remainder | 25.00 | n.d. | 9.50 | n.d. | n.d. |
| 8 | 0.42 | 0.09 | 0.06 | 0.004 | 0.001 | remainder | 25.70 | 0.01 | 9.70 | 0.01 | 0.13 |
| 9 | 0.42 | 0.10 | 0.06 | 0.005 | 0.001 | remainder | 25.35 | 0.01 | 9.95 | 0.01 | 0.12 |
| 10 | 0.42 | 0.01 | 0.16 | 0.010 | 0.001 | remainder | 25.85 | 0.07 | 9.02 | 0.02 | 0.06 |
| 11 | 0.44 | 0.05 | 0.19 | 0.010 | 0.002 | remainder | 30.40 | 0.07 | 10.71 | 0.02 | 0.05 |
| 12 | 0.45 | 0.03 | 0.16 | 0.010 | 0.001 | remainder | 25.60 | 0.07 | 9.23 | 0.02 | 0.06 |
| 13 | 0.45 | 0.06 | 0.16 | 0.010 | 0.001 | remainder | 26.70 | 0.08 | 9.25 | 0.02 | 0.06 |
| 14 | 0.40 | 0.04 | 0.16 | 0.010 | 0.001 | remainder | 25.10 | 0.08 | 9.15 | 0.02 | 0.06 |
| 15 | 0.41 | 0.08 | 0.14 | 0.010 | 0.010 | remainder | 25.85 | 0.08 | 9.01 | 0.04 | 0.06 |
| 16 | 0.41 | 0.06 | 0.13 | 0.011 | 0.001 | remainder | 25.40 | 0.08 | 9.15 | 0.04 | 0.07 |
| 17 | 0.48 | 0.06 | 0.13 | 0.010 | 0.001 | remainder | 25.80 | 0.08 | 8.95 | 0.04 | 0.07 |
| 18 | 0.44 | 0.05 | 0.13 | 0.010 | 0.001 | remainder | 25.85 | 0.08 | 8.95 | 0.04 | 0.82 |
| 19 | 0.42 | 0.05 | 0.13 | 0.010 | 0.001 | remainder | 25.80 | 0.07 | 8.90 | 0.04 | 0.06 |
| 20 | 0.43 | 0.06 | 0.13 | 0.010 | 0.001 | remainder | 25.40 | 0.09 | 8.75 | 0.04 | 0.06 |
| 21 | 0.51 | 0.08 | 0.13 | 0.010 | 0.001 | remainder | 26.15 | 0.07 | 9.05 | 0.04 | 0.08 |
| 22 | 0.64 | 0.07 | 0.14 | 0.009 | 0.001 | remainder | 25.70 | 0.07 | 8.45 | 0.04 | 0.06 |
| 23 | 0.44 | 0.06 | 0.04 | 0.004 | 0.001 | remainder | 26.40 | 0.07 | 0.95 | 0.02 | 0.03 |
| 24 | 0.42 | 0.05 | 0.03 | 0.004 | 0.001 | remainder | 26.10 | 3.92 | 0.39 | 0.03 | 0.04 |
| 25 | 0.47 | 0.06 | 0.04 | 0.005 | 0.001 | remainder | 22.30 | 0.11 | 4.30 | 0.02 | 4.50 |

| Alloy | Cu | Co | Nd | Tl | Zr | Y | A1 | B | N |
|---|---|---|---|---|---|---|---|---|---|
| 1 | 0.03 | 0.01 | 0.84 | 0.10 | 0.02 | n.d. | 0.13 | 0.0003 | 0.039 |
| 2 | 0.01 | n.d. | 0.51 | <0.01 | <0.01 | <0.01 | <0.01 | n.d. | 0.018 |
| | 0.09 | | 1.28 | 0.26 | 0.20 | | 0.03 | | 0.115 |
| 3 | 0.03 | 0.01 | 1.02 | 0.06 | 0.05 | n.d. | 0.07 | 0.0004 | 0.072 |
| 4 | 0.02 | 0.05 | 0.96 | 0.10 | 0.03 | n.d. | 0.00 | 0.0018 | 0.107 |
| 5 | n.d. | n.d. | n.d. | n.d. | n.d. | n.d. | 4.5 | n.d. | n.d |
| 6 | 0.03 | 0.01 | 0.98 | 0.02 | 0.01 | n.d. | 0.01 | 0.0054 | 0.084 |
| 7 | 0.05 | n.d. | n.d. | 0.15 | 0.05 | 0.085 | 2.1 | n.d. | n.d. |
| 8 | 0.01 | 0.06 | 1.06 | 0.15 | 0.08 | 0.019 | 2.3 | n.d. | n.d. |
| 9 | 0.02 | 0.06 | 0.99 | 0.13 | 0.06 | 0.055 | 2.5 | n.d. | 0.055 |
| 10 | 0.05 | 0.10 | 0.03 | 0.13 | 0.05 | 0.028 | 2.5 | 0.0033 | 0.052 |
| 11 | 0.05 | 0.09 | 0.10 | 0.14 | 0.05 | 0.024 | 2.4 | 0.0034 | 0.060 |
| 12 | 0.05 | 0.09 | 0.53 | 0.12 | 0.05 | 0.029 | 2.3 | 0.0033 | 0.049 |
| 13 | 0.05 | 0.09 | 1.00 | 0.14 | 0.05 | 0.028 | 2.4 | 0.0041 | 0.050 |
| 14 | 0.06 | 0.10 | 0.03 | 0.15 | 0.05 | 0.025 | 3.6 | 0.0038 | 0.039 |
| 15 | 0.03 | 0.05 | 1.10 | 0.19 | 0.07 | 0.070 | 3.8 | 0.0023 | 0.034 |
| 16 | 0.03 | 0.03 | 2.07 | 0.17 | 0.08 | 0.066 | 3.7 | 0.0008 | 0.043 |
| 17 | 0.03 | 0.04 | 1.15 | 0.18 | 0.06 | 0.061 | 3.9 | 0.0005 | 0.042 |
| 18 | 0.03 | 0.05 | 1.09 | 0.18 | 0.08 | 0.066 | 3.7 | 0.0005 | 0.038 |
| 19 | 0.03 | 0.04 | 1.11 | 0.18 | 0.05 | 0.061 | 3.3 | 0.0004 | 0.047 |
| 20 | 0.02 | 0.05 | 1.05 | 0.16 | 0.06 | 0.055 | 4.8 | 0.0020 | 0.034 |
| 21 | 0.03 | 0.05 | 1.10 | 0.16 | 0.07 | 0.047 | 3.0 | 0.0004 | 0.047 |
| 22 | 0.02 | 0.04 | 1.00 | 0.18 | 0.06 | 0.046 | 3.1 | 0.0004 | 0.033 |
| 23 | 0.01 | 0.04 | 1.06 | 0.16 | 0.08 | 0.049 | 3.4 | 0.0004 | 0.052 |
| 24 | 0.01 | 6.35 | 1.00 | 0.16 | 0.01 | 0.045 | 3.7 | 0.0011 | 0.048 |
| 25 | 0.01 | 8.20 | 1.00 | 0.22 | 0.05 | 0.047 | 3.6 | 0.0010 | 0.031 |

The table includes, as an example for two wrought alloys which are not covered by the invention and have a comparatively low carbon content and a very fine-grained microstructure with a grain size of ≤10 μm, comparative alloys 5 and 7, whereas all the other test alloys are casting alloys.

Yttrium has a strong oxide-forming action which, in the alloy according to the invention, considerably improves the formation conditions and bonding of the $\alpha$-$Al_2O_3$ layer.

Figure 2:
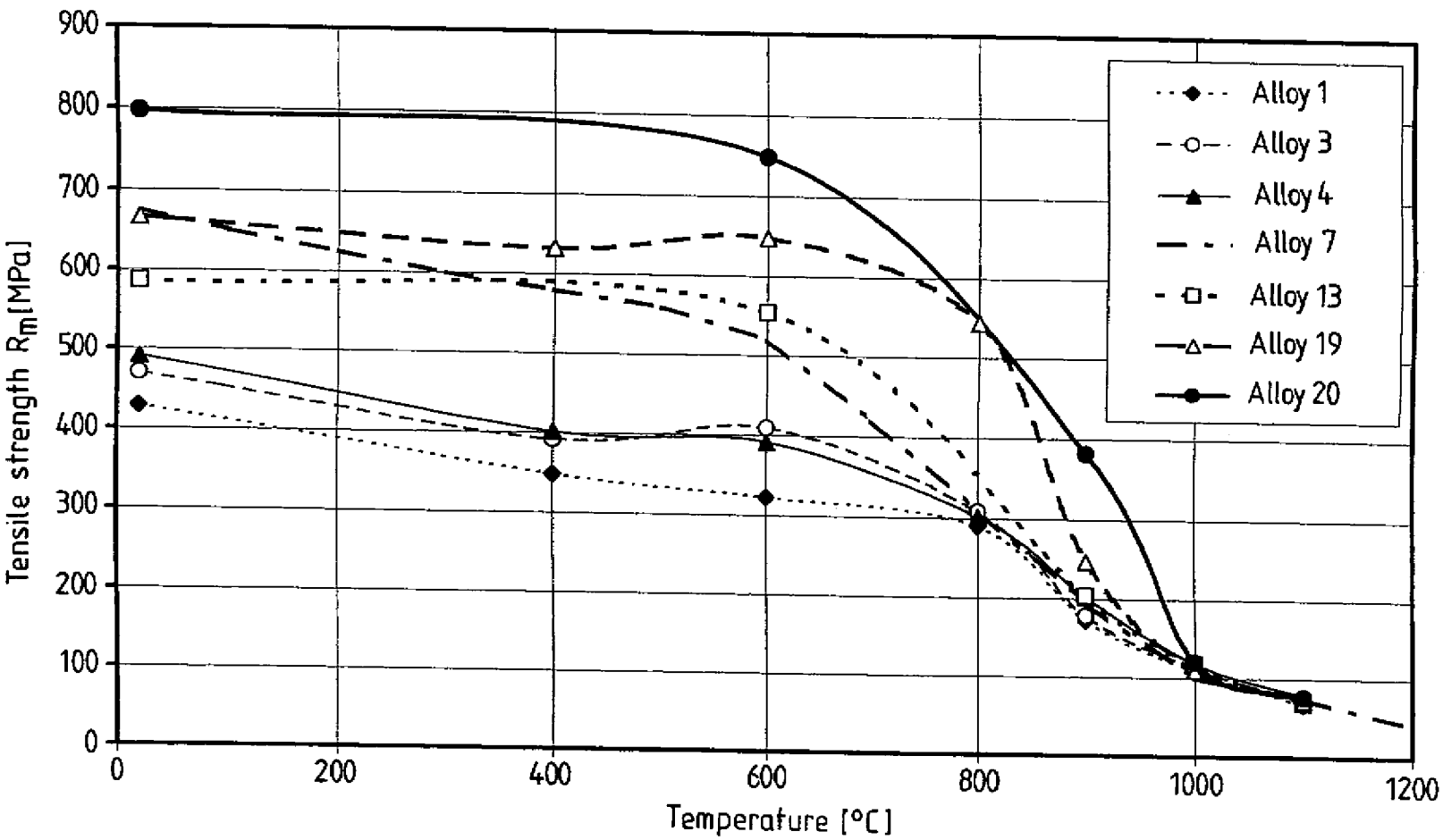
FIG. 2 shows a graphical illustration of the alloys, illustrating the tensile strength as a function of the temperature.
Figure 3:
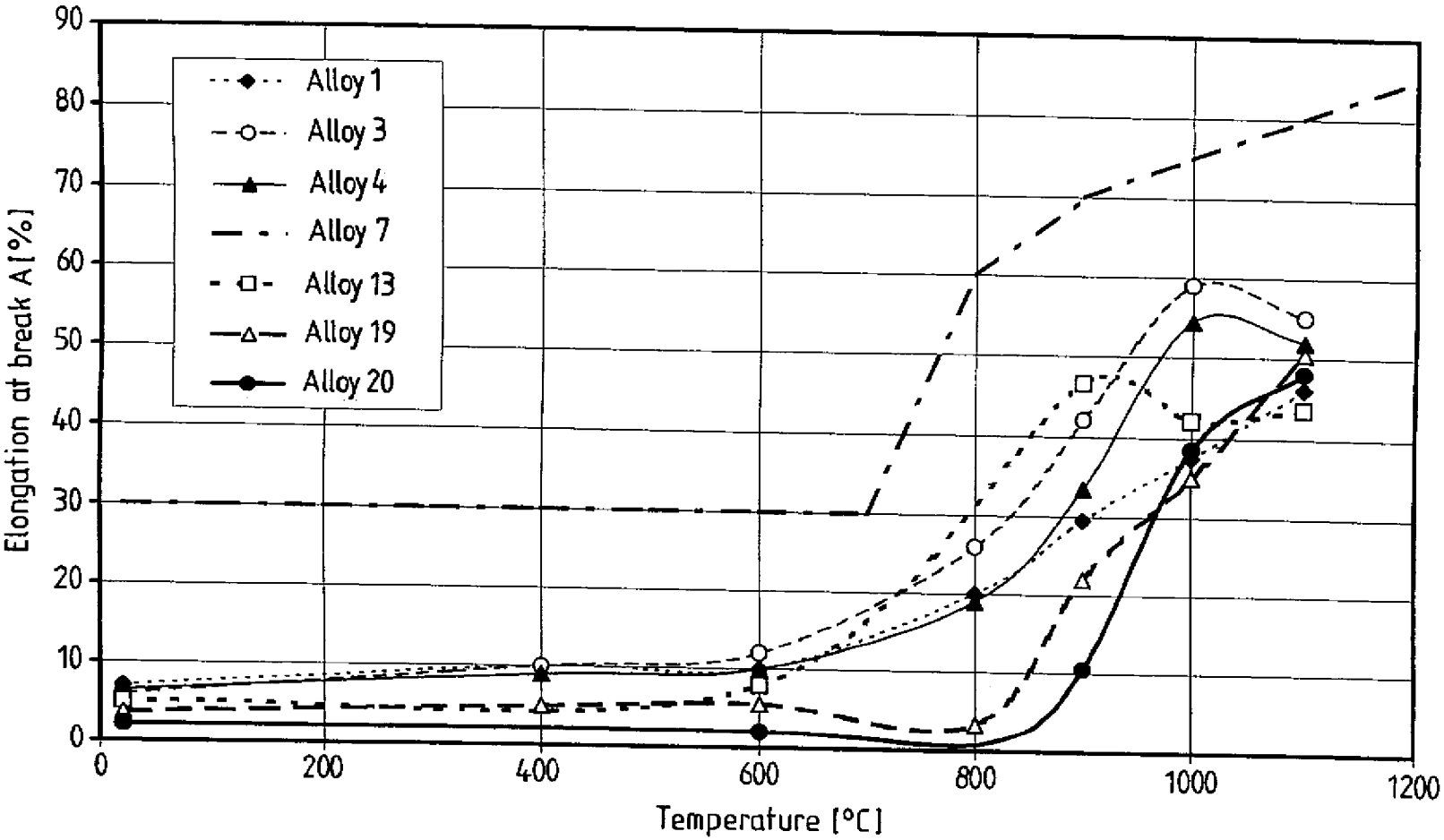
FIG. 3 shows a graphical illustration of the alloys, illustrating the elongation at break as a function of the temperature.

The aluminum content of the alloy according to the invention has an important role in that aluminum leads to the formation of a γ' precipitation phase, which significantly increases the tensile strength. As can been seen from the diagrams presented in FIGS. 1 and 2, the yield strength and the tensile strength of the three alloys according to the invention 13, 19, 20 to 900° C. are well above the corresponding strengths of the four comparative alloys. The elongation at break of the alloys according to the invention substantially correspond to that of the comparative alloys; it increases considerably above approximately 900° C., as can be seen from the diagram presented in FIG. 3, while the strength reaches the level of the comparative alloys (FIGS. 1, 2). This can be explained by the fact that above approximately 900° C. the γ' phase starts to form a solution, and is completely dissolved at above approximately 1000° C.

Figure 4:
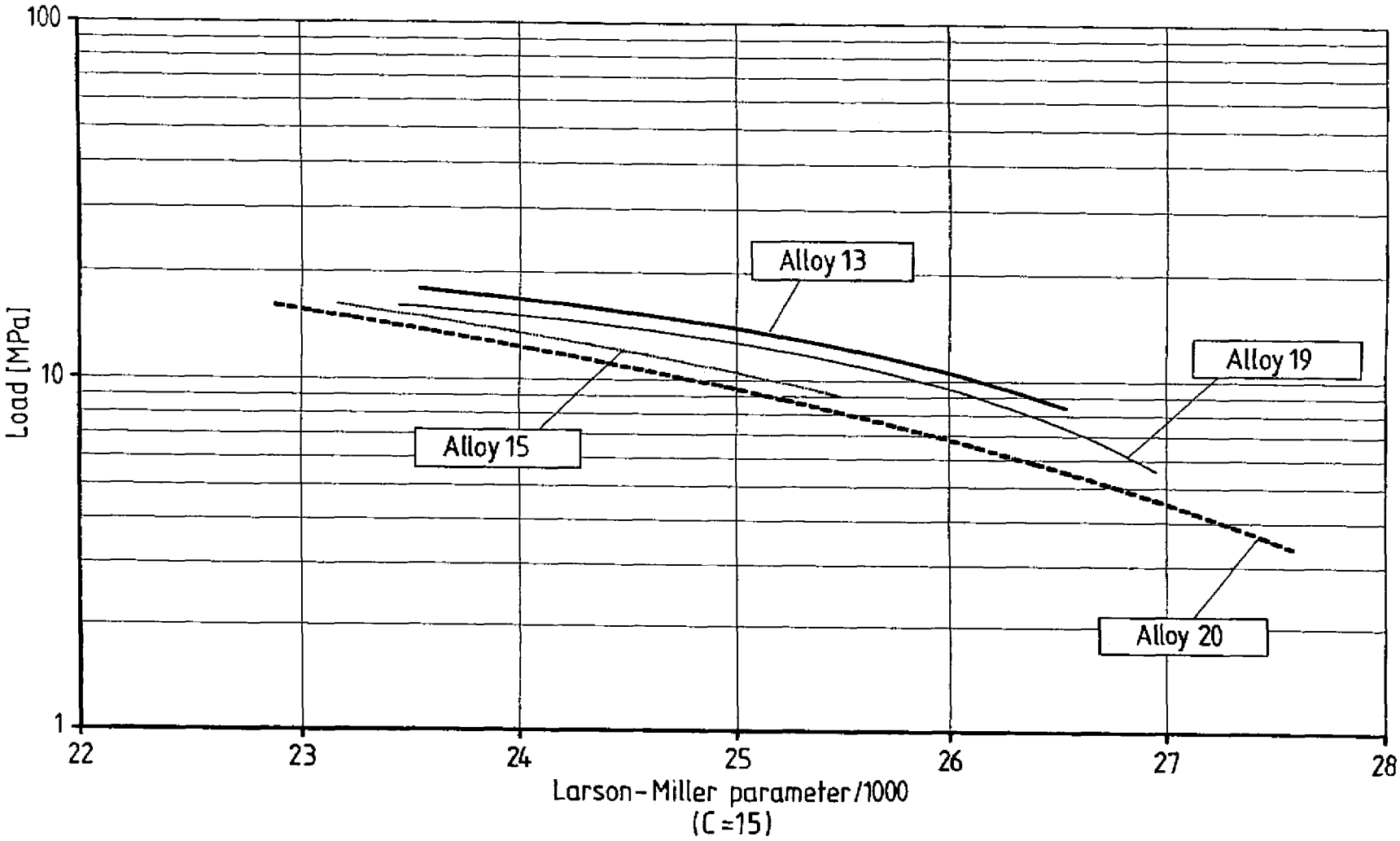
FIG. 4 shows a graphical illustration of alloys, illustrating the load as a function of the Larson-Miller parameter/100.

The limiting rupture strength of alloys according to the invention with different aluminum contents is presented in the Larson-Miller diagram shown in FIG. 4. Absolute temperatures (T in ° K) and service life until fracture ($t_B$ in h) are linked to one another by the Larson-Miller parameter LMP:

$$LMP=T\cdot(C+\log_{10}(t_B)).$$

Figure 5:
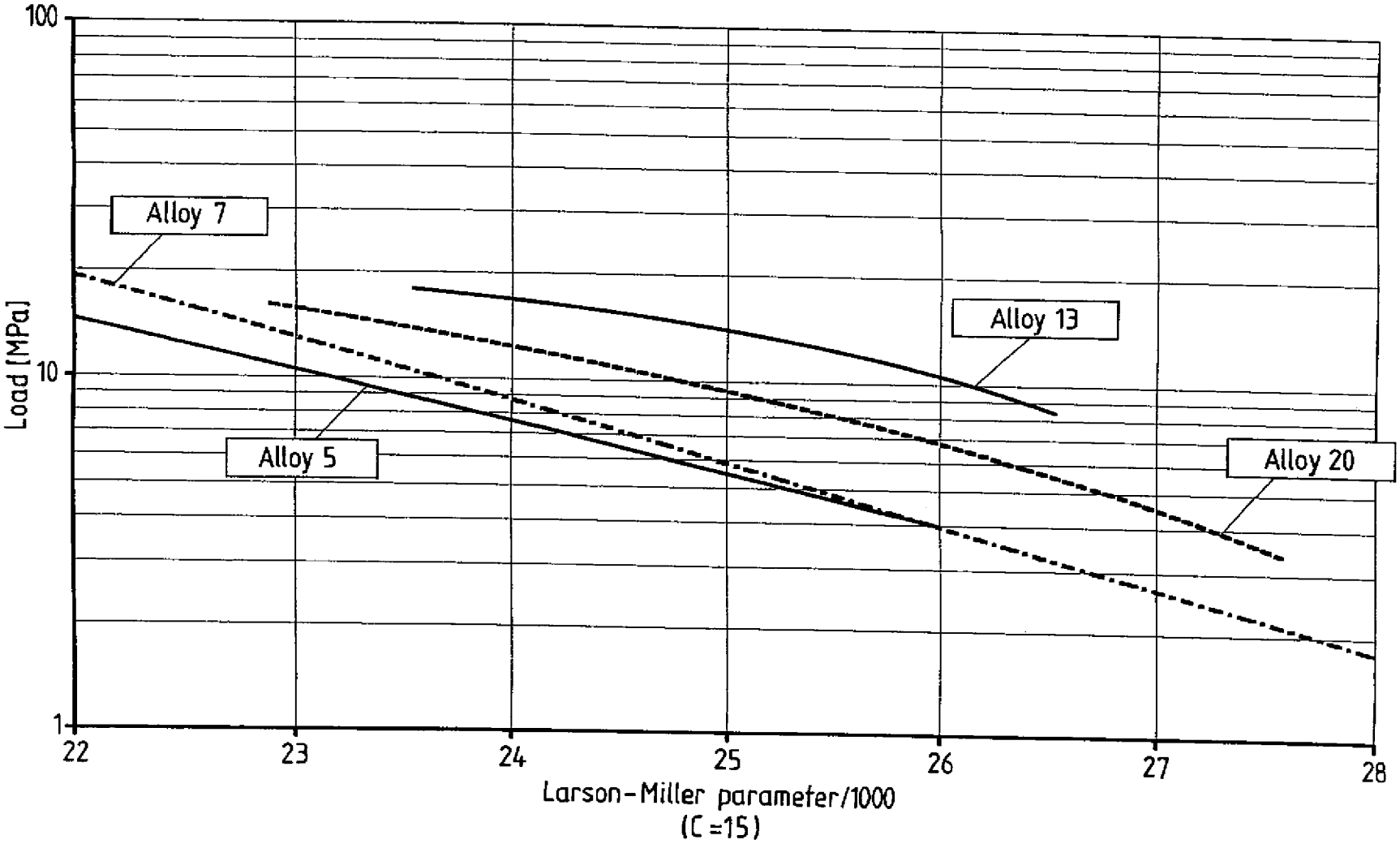
FIG. 5 shows a graphical illustration of other alloys, illustrating the load as a function of the Larson-Miller parameter/100.
Figure 6:
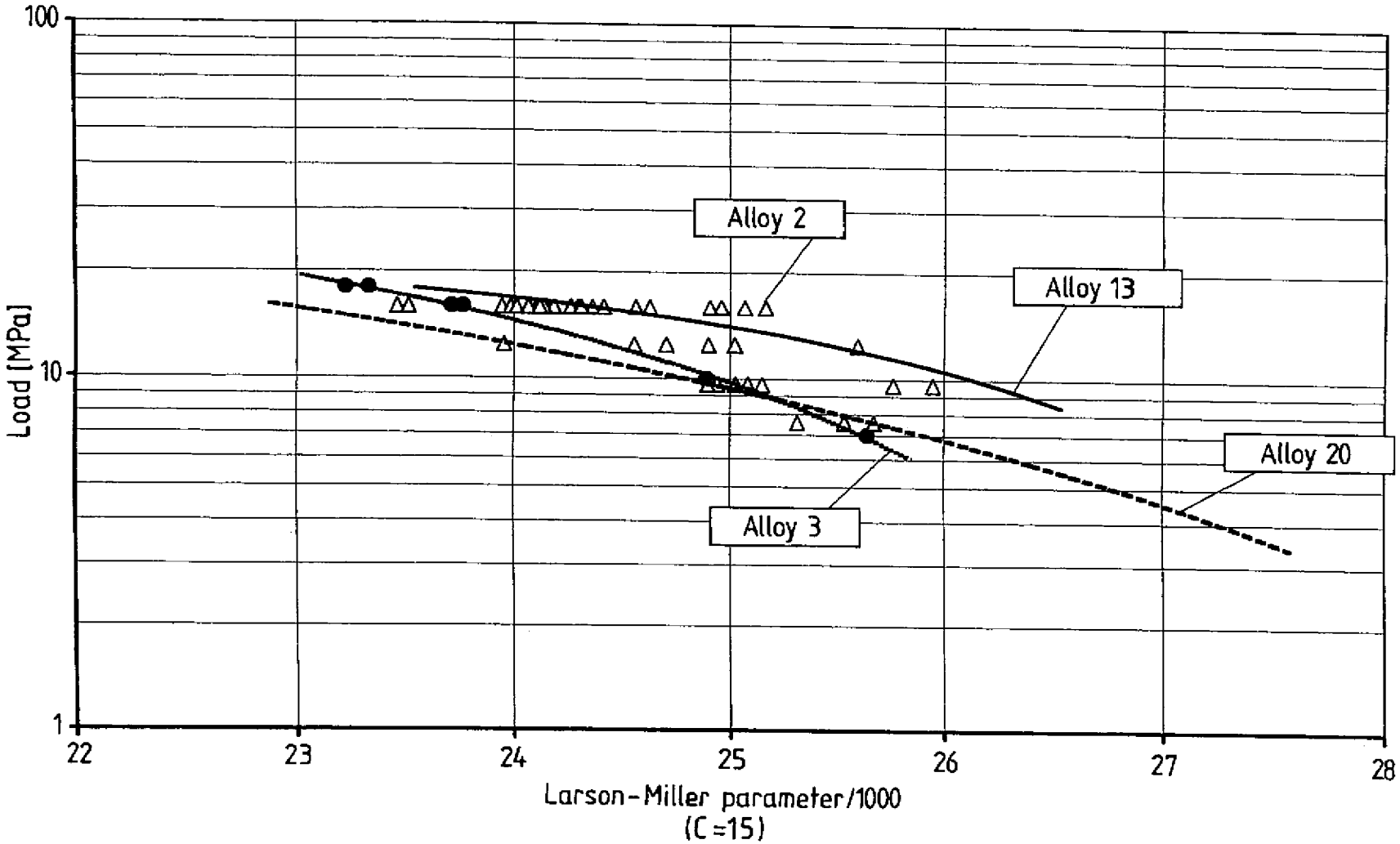
FIG. 6 shows a graphical illustration of still other alloys, illustrating the load as a function of the Larson-Miller parameter/100.
Figure 7:
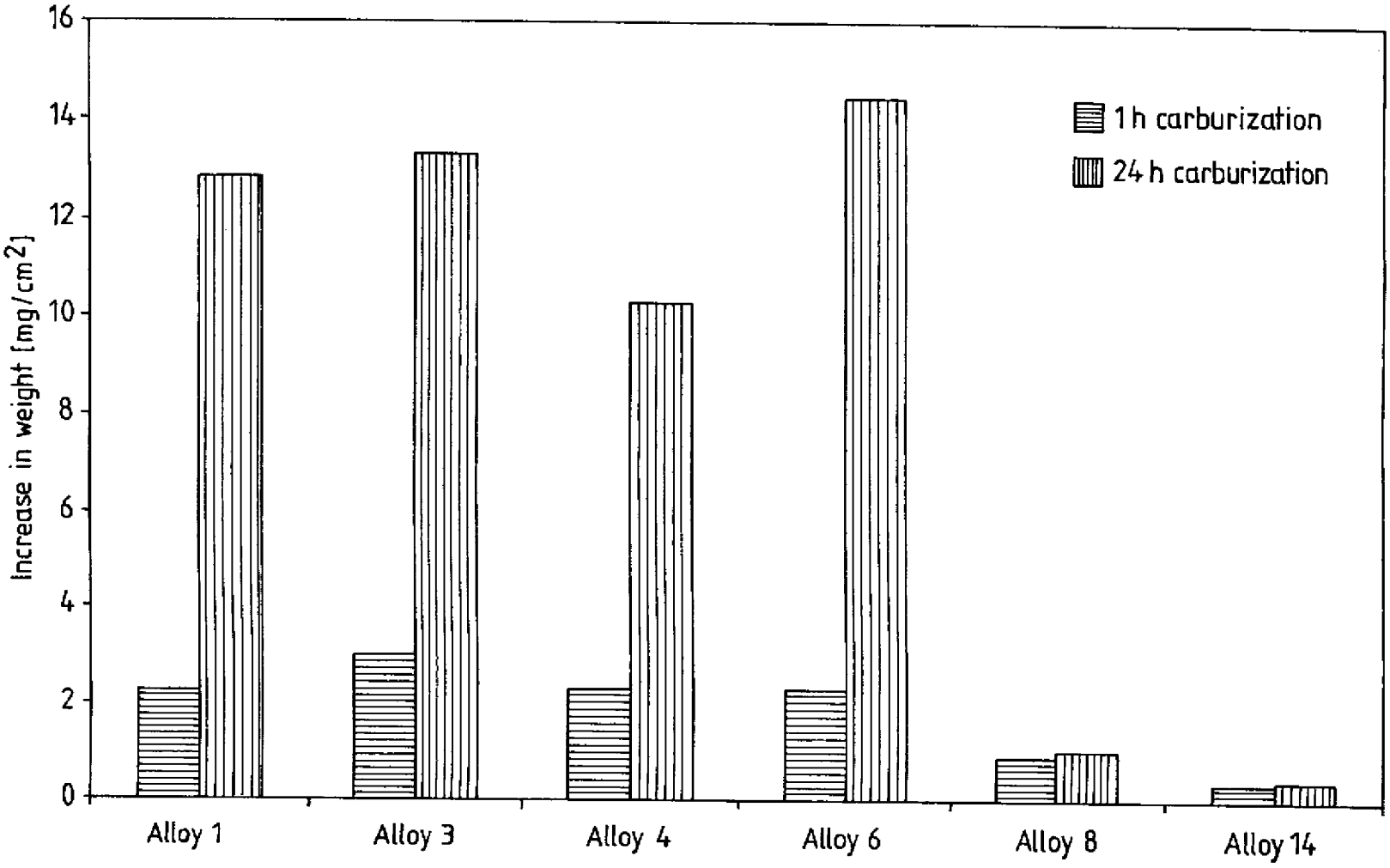
FIG. 7 shows a graphical illustration of comparative tests between alloys according to the invention and standard alloys at a temperature of 1100° C.

According to the illustration presented in FIG. 4, different aluminum contents lead to different service lives until fracture. The limiting rupture stress of the alloys according to the invention are much superior to those of conventional oxidation-resistant wrought alloys (FIG. 5). If alloys according to the invention are compared with conventional centrifugally cast materials, similar service lives until fracture are observed in the temperature range of around 1100° C.

In the range around 1200° C., i.e. with greater Larson-Miller parameters, there are no known service life data for conventional centrifugally cast materials, whereas limiting rupture stresses of from 5.8 to 8.5 MPa are still observed for the alloys according to the invention for service lives of 1000 h, depending on the composition.

Figure 8:
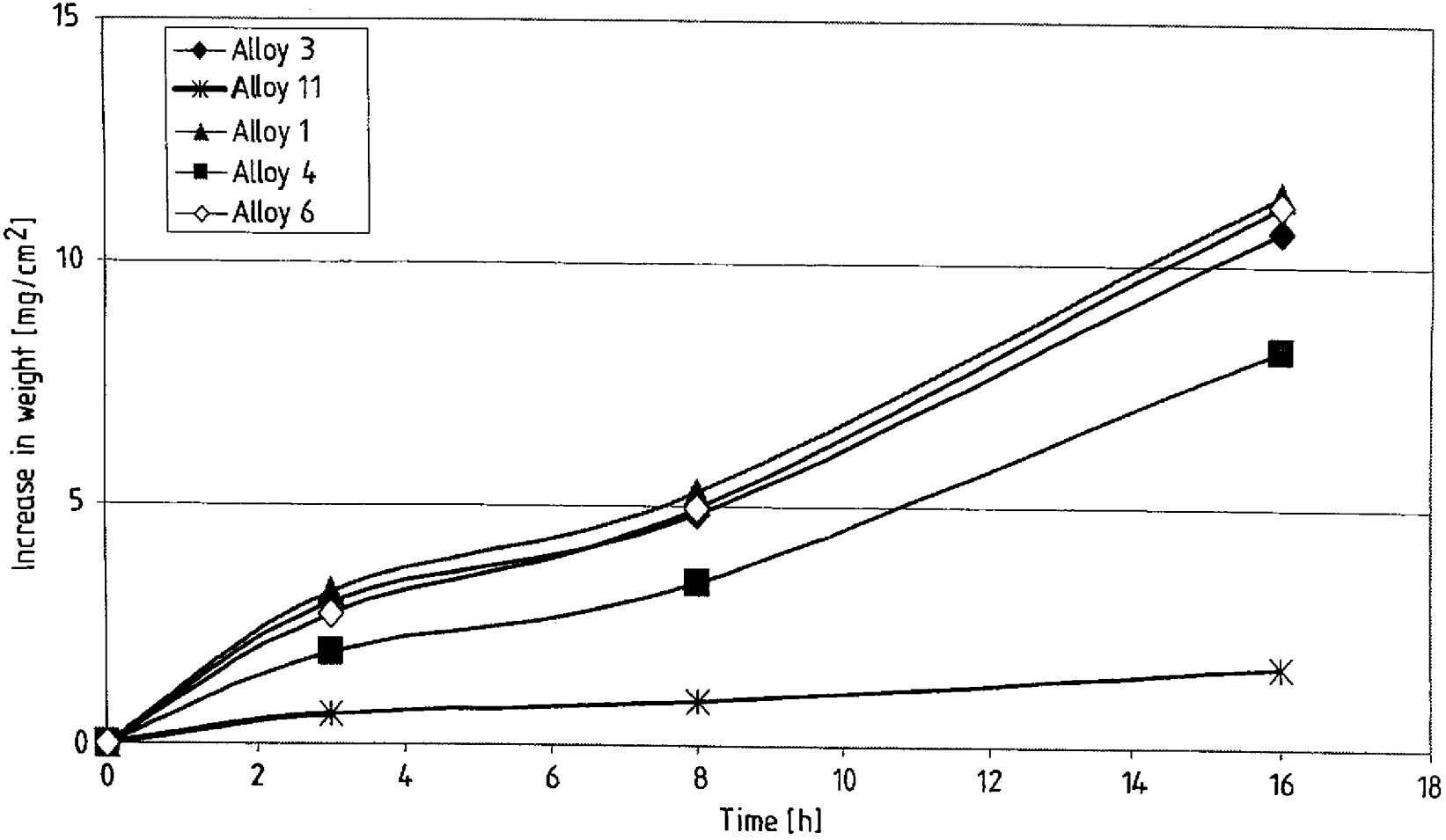
FIG. 8 shows a graphical illustration of alloys, illustrating the increase in weight as a function of time.
Figure 9:
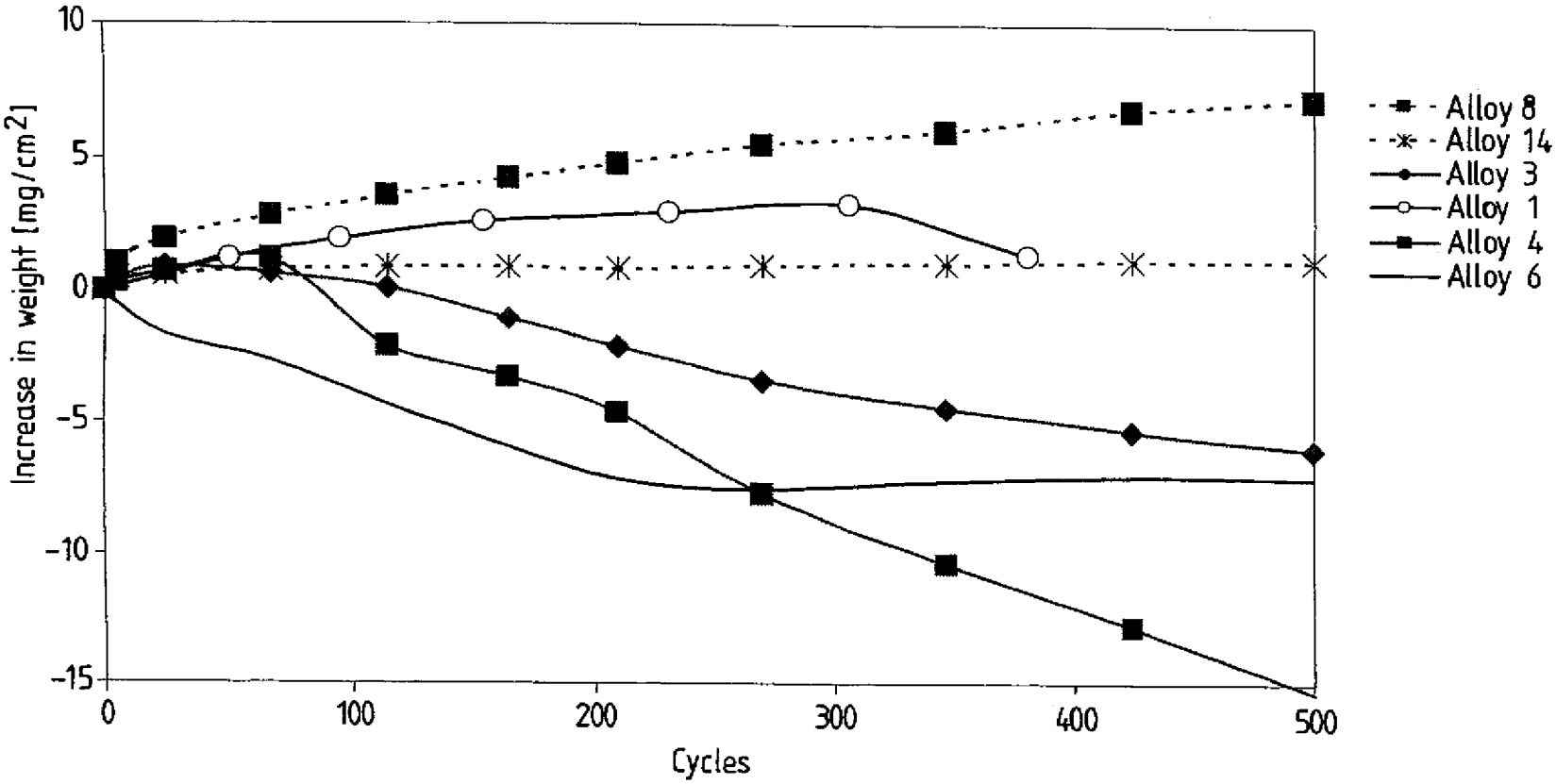
FIGS. 9 and 10 show graphical illustrations of alloys, illustrating the increase in weight as a function of cycles.

Further tests, in which the resistance to carburization of various specimens was tested in a slightly oxidizing atmosphere comprising hydrogen and 5% by volume of $CH_4$, reveal the superiority of the alloy according to the invention compared to four standard alloys at a temperature of 1100° C. The long-time performance is of particular importance. The test results are presented in graph form in the diagram shown in FIG. 7. It can be seen from this diagram that the two alloys according to the invention 8 and 14 have carburization resistance which remains constant over the course of time, and that in the case of alloy 14 comprising 3.55% of aluminum, this is even better than in the case of alloy 8 with an aluminum content of just 2.30%. The diagram presented in FIG. 8 shows the carburization over the course of time as the increase in weight for the alloy according to the invention 11 containing 2.40% of aluminum compared to the four standard alloys 1, 3, 4 and 6, with much lower aluminum contents. This figure likewise reveals the superiority of the alloy according to the invention.

To simulate practical conditions, cyclical carburization tests were carried out, in which the specimens were alternatively held at a temperature of 1100° C. for 45 min and then at room temperature for 15 min in an atmosphere comprising hydrogen together with 4.7% by volume of $CH_4$ and 6% by volume of steam. The results of the tests, which each comprise 500 cycles, are shown in the diagram presented in FIG. 9. Whereas specimens 8, 14 in accordance with the invention experienced no or only a slight change in weight, the formation of scale and flaking of the scale led to considerable weight losses in the case of comparative specimens 1, 3, 4, 6, and in the case of comparative specimen 1 after just approximately 300 cycles. Furthermore, the alloy 14 according to the invention, with its higher aluminum content, once again reveals better corrosion properties than alloy 8, which is likewise covered by the invention.

Figure 10:
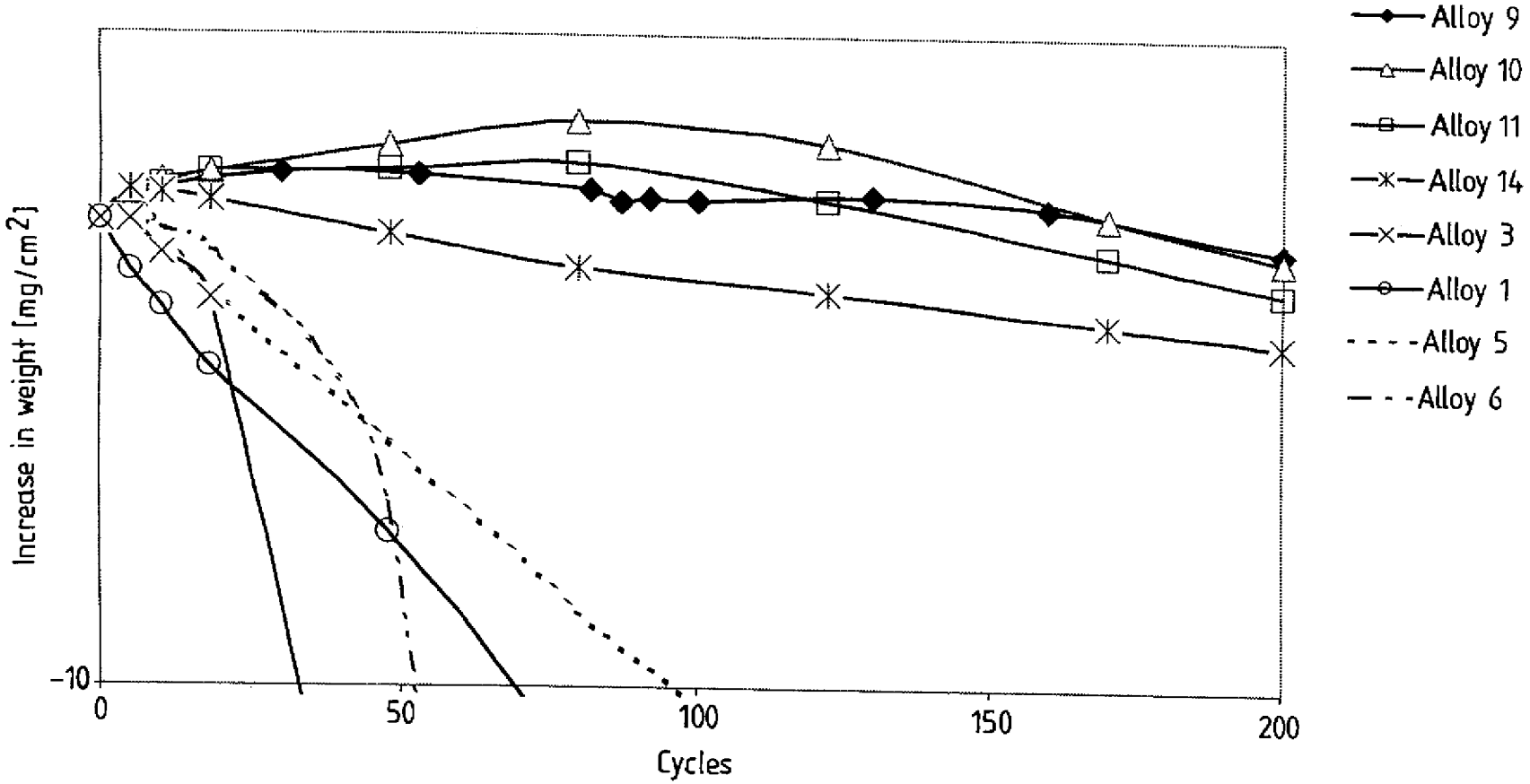
Figure 11:
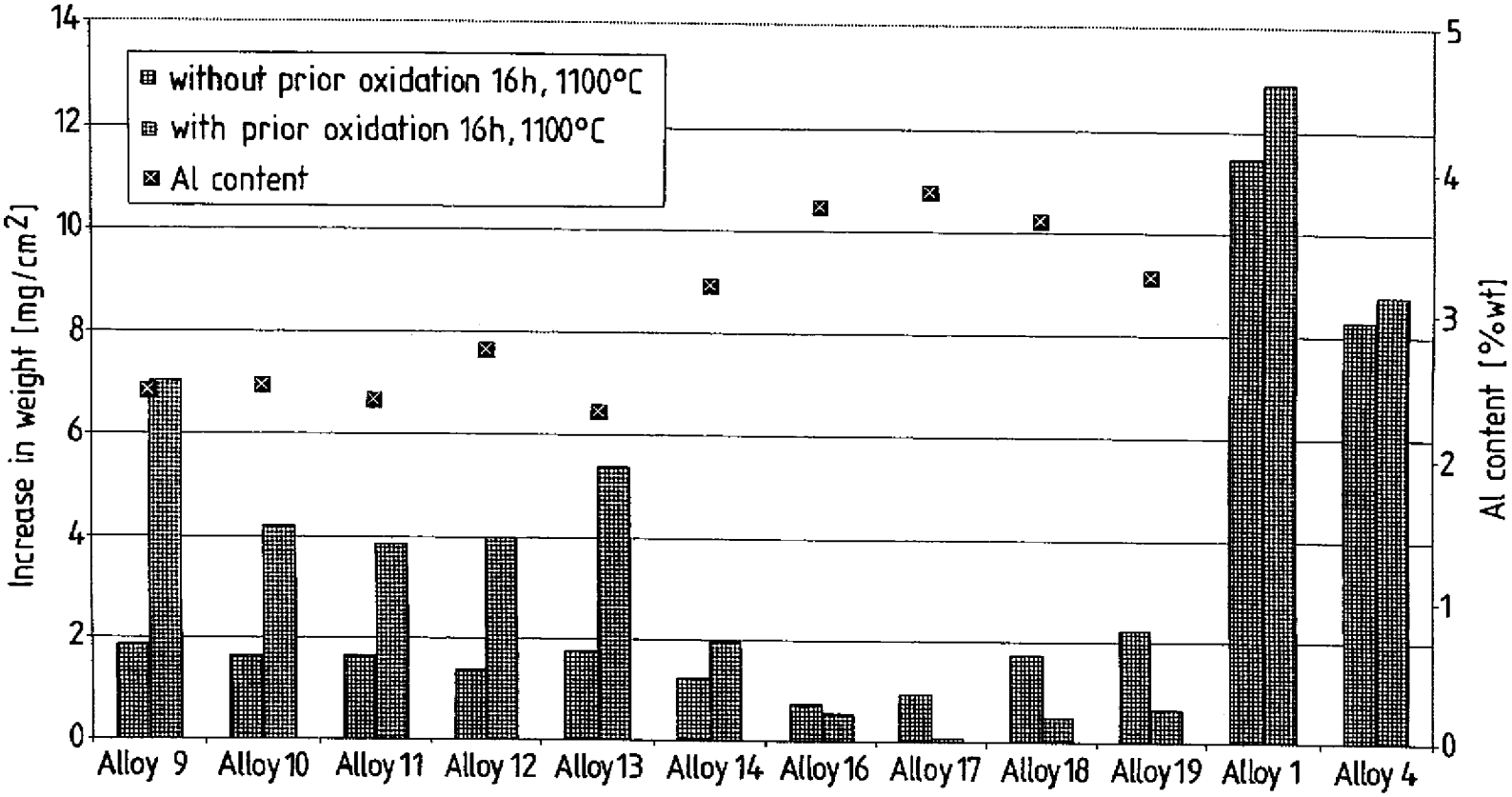
FIG. 11 shows a graphical illustration of test results of alloys with regard to influence of preliminary oxidation on the carburization behavior.
Figure 12:
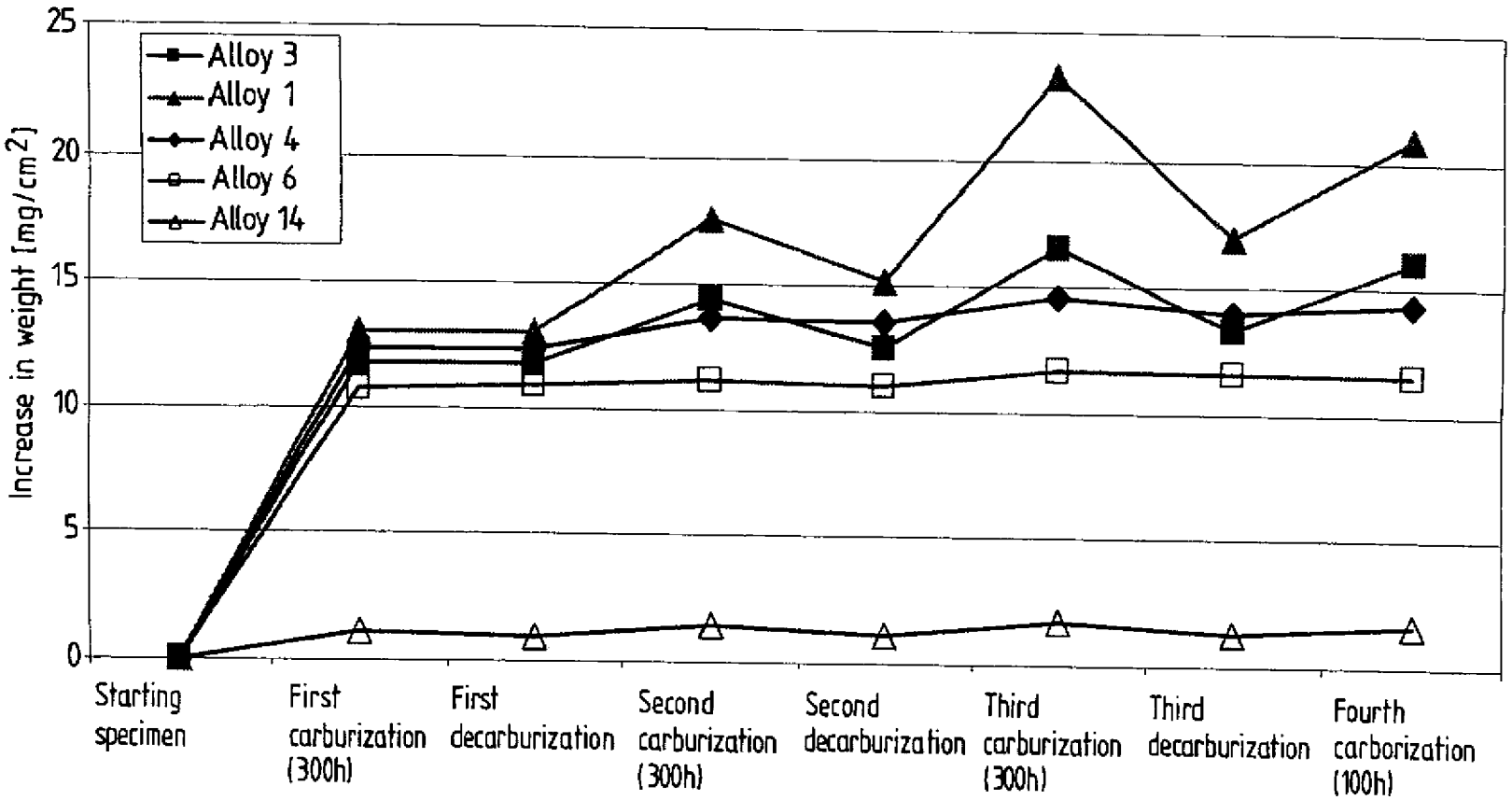
FIG. 12 shows a graphical illustration of alloys, illustrating the increase in weight as a function of time between an alloy according to the invention and standard alloys.

The results of further tests, in which the specimens were subjected to cyclical thermal loading at 1150° C. in dry air, are presented in the diagram shown in FIG. 10. The curves reveal the superiority of the test alloys according to the invention (top set of curves) compared to the conventional alloys (bottom set of curves), which were subject to a considerable weight loss after just a few cycles. The results indicate a stable, securely bonded oxide layer in the case of the alloys according to the invention. To establish the influence of preliminary oxidation on the carburization behavior, ten specimens of the alloy according to the invention were exposed to an atmosphere comprising argon with a low oxygen content at 1240° C. for 24 hours and were then carburized for 16 hours at a temperature of 1100° C. in an atmosphere comprising hydrogen containing 5% by volume of $CH_4$. The test results are presented in graph form in the diagram shown in FIG. 11, which also indicates the corresponding aluminum contents. Accordingly, a slightly oxidizing annealing treatment reduces the resistance to carburization of the specimens according to the invention up to an aluminum content of 3.25% (specimen 14); as the aluminum content rises further, the resistance to carburization of the alloy which has been annealed in accordance with the invention improves (specimens 16 to 19), while at the same time the diagram clearly reveals the poor carburization behavior of the comparative specimens 1 (0.128% of aluminum) and 4 (0.003% of aluminum). The deterioration in the resistance to carburization at lower aluminum contents can be explained by the fact that the inheritantly protective oxide layer cracks open or (partially) flakes off during cooling after the annealing treatment, so that carburization occurs in the region of the cracks and flaked-off areas. At higher aluminum contents, the abovementioned $Al_2O_3$ barrier layer is formed beneath the oxide layer (covering layer).

In a test carried out under conditions close to those encountered in practice, a number of specimens were subjected to cyclical carburization and decarburization in accordance with the NACE standard. Each cycle comprised carburization for three hundred hours in an atmosphere comprising hydrogen and 2% by volume of $CH_4$, followed by decarburization for twenty-four hours in an atmosphere comprising air and 20% by volume of steam at 770° C. The test comprised four cycles. It can be seen from the diagram presented in FIG. 12 that the specimen in accordance with the invention 14 underwent scarcely any change in weight, whereas in the case of comparative specimens 1, 3, 4, 6 a considerable increase in weight or carburization occurred, and this did not disappear even during the decarburization.

Figure 13:
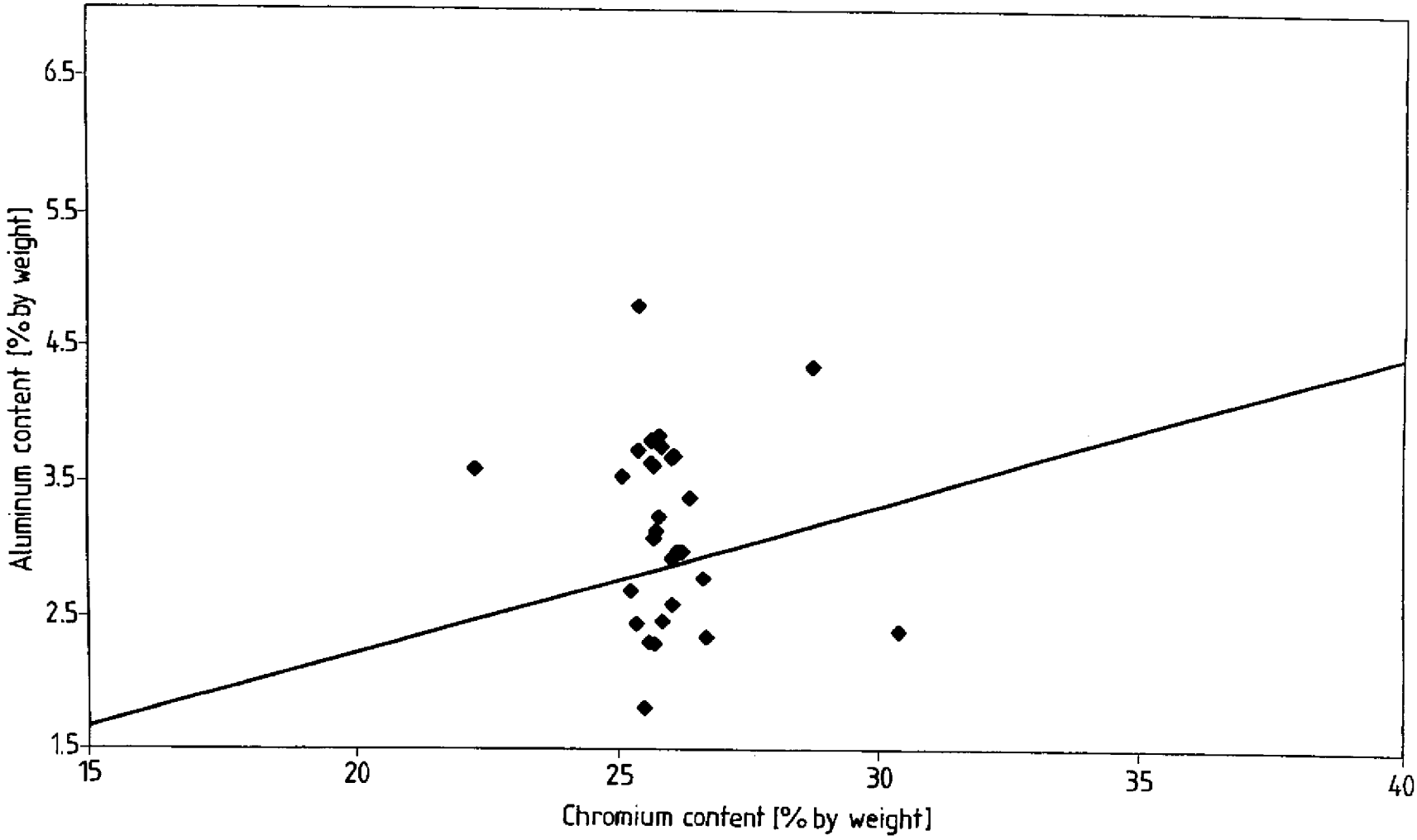
FIG. 13 shows a graphical illustration of contents of the alloy according to the invention, FIG. 14 show a graphical illustration of a comparison between steel alloys according to the invention and alloys.

The diagram presented in FIG. 13 reveals that the contents in the alloy according to the invention should be matched to one another in such a way that the following condition is satisfied:

$$9[\%\ Al] \geq [\%\ Cr].$$

The straight line in the diagram shown in FIG. 13 divides the range of alloys with a sufficiently protective α-aluminum oxide layer above the straight line from the range of alloys with a resistance to carburization or catalytic coking which is adversely affected by mixed oxides.

Figure 14:
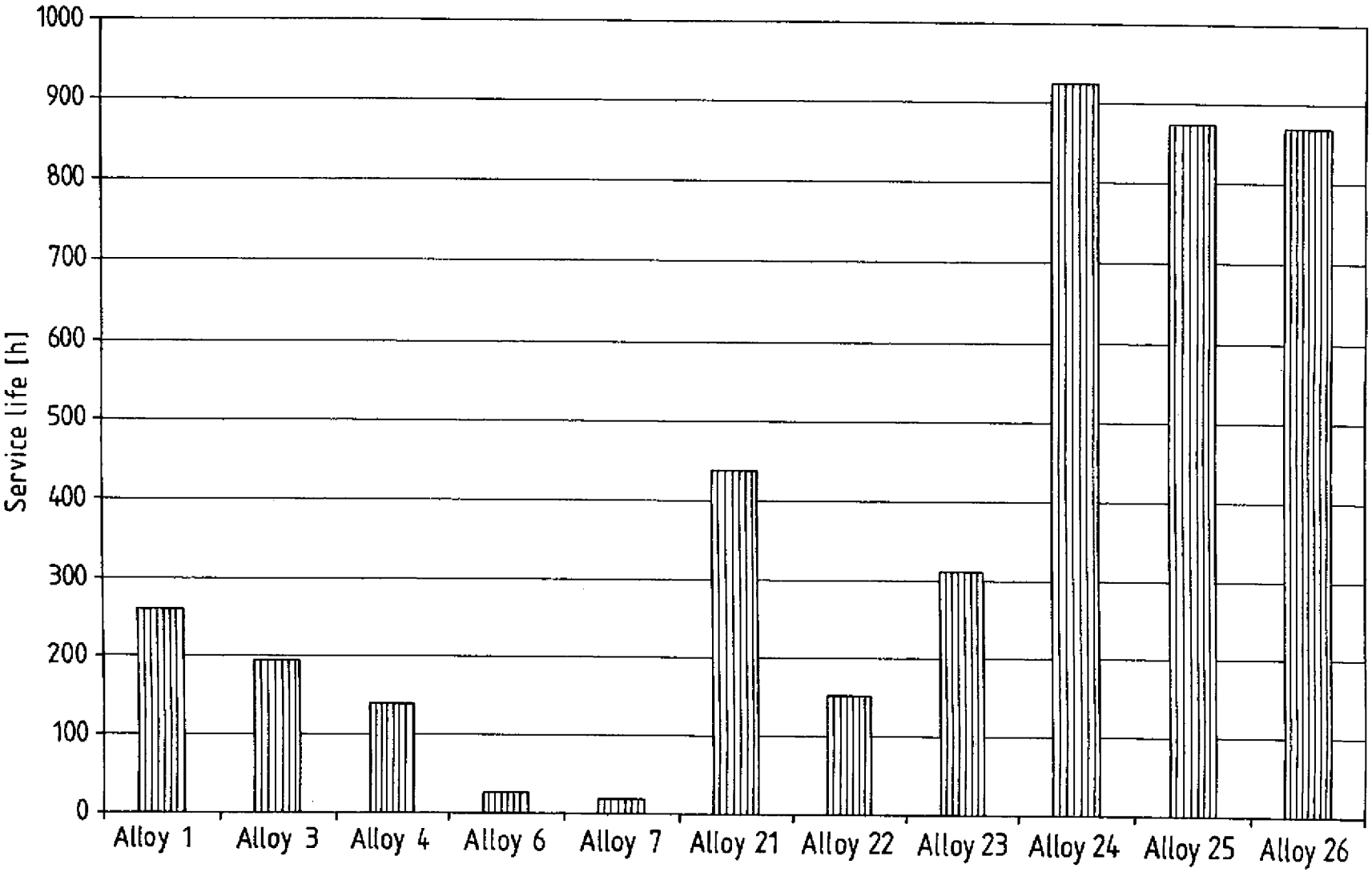

The diagram illustrated in FIG. 14 reveals the superiority of the steel alloy according to the invention using six exemplary embodiments 21 to 26 by comparison with the conventional comparative alloys 1, 3, 4, 6 and 7. The compositions of the comparative alloys 21 to 26 are given in the table.

Figure 15:
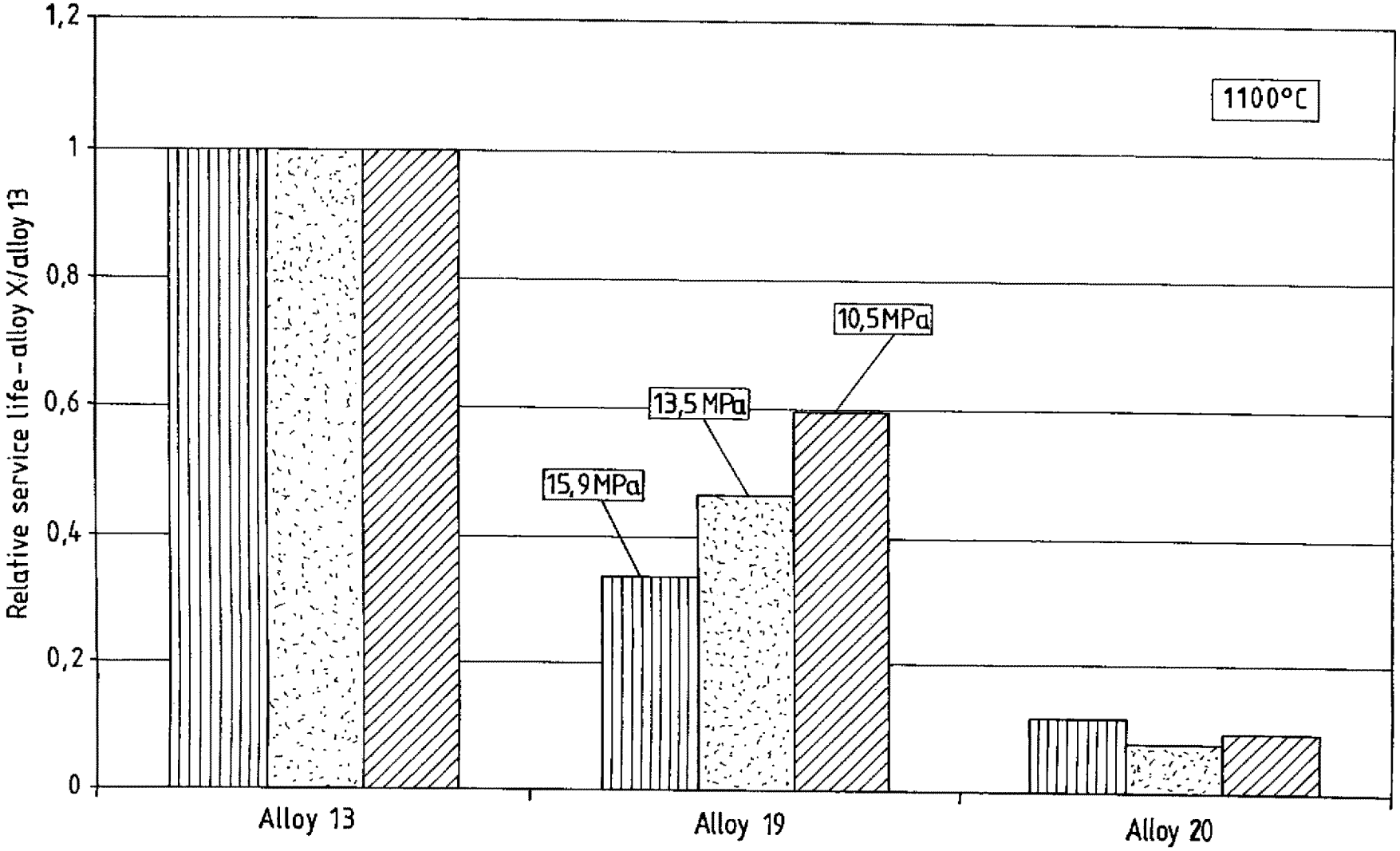
FIGS. 15 and 16 show graphical illustrations of an alloy according to the invention with respect to influence of the aluminum.
Figure 16:
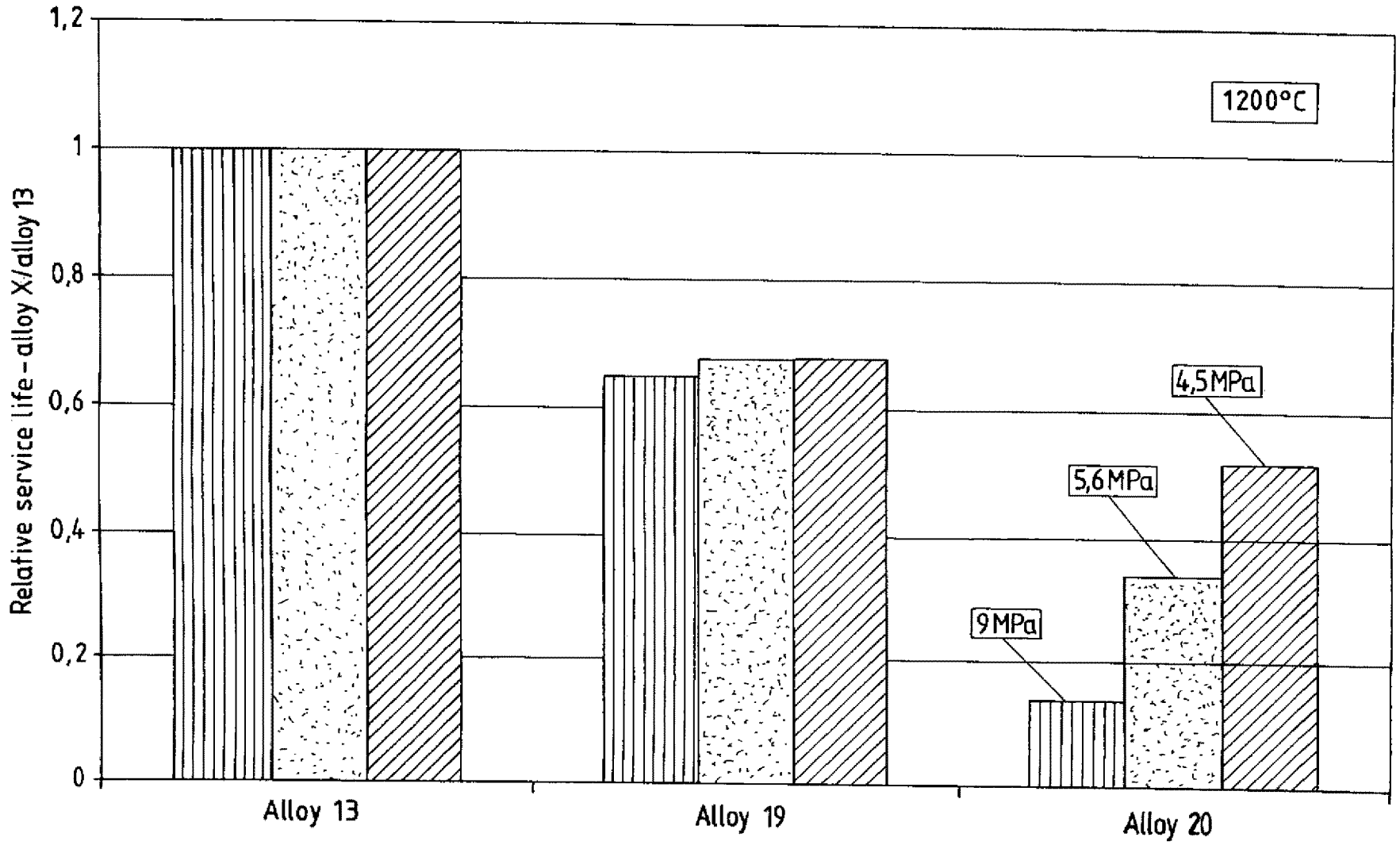

To illustrate the influence of the aluminum within the content limits according to the invention, the diagrams presented in FIGS. 15 and 16 compare the service life of the alloy according to the invention 13, comprising 2.4% of aluminum, as reference variable, with service life 1, in each case at 1100° C. (FIG. 15) and 1200° C. (FIG. 16) for three loading situations (15.9 MPa; 13.5 MPa; 10.5 MPa) with the service lives of the alloys according to the invention 19 (3.3% of aluminum) and 20 (4.8% of aluminum) referenced on the basis of the above reference variable.

The diagram shown in FIG. 15 reveals that in the case of alloy 19, with a medium aluminum content of 3.3%, the decrease in the service life becomes more intensive with increasing load, whereas in the case of alloy 20, with its high aluminum content of 4.8%, there is a strong but approximately equal decrease in the relative service life for all the loading situations. The diagram for 1200° C. reveals a reduction in the service life when the aluminum content is increased from 2.4% (alloy 13) to 3.3% (alloy 19) for all three loading situations, with the relative service life dropping by approximately one third. A further increase in the aluminum content to 4.8% (alloy 20) in turn reveals a load-dependent reduction in the relative service life.

Overall, the two diagrams reveal that as the aluminum content increases, the service life until fracture in the limiting rupture stress test is reduced. Furthermore, as the temperature increases and the duration of loading increases and/or the loading level decreases, the negative influence of the aluminum on the limiting rupture stress life decreases. In other words: the alloys with a high aluminum content are particularly suitable for long-term use at temperatures for which it has hitherto been impossible to use cast or centrifugally cast materials.

In view of their superior strength properties and their excellent resistance to carburization and oxidation, the casting alloy according to the invention is particularly suitable for use as a material for furnace parts, radiant tubes for heating furnaces, rollers for annealing furnaces, parts of continuous-casting and strip-casting installations, hoods and muffles for annealing furnaces, parts of large diesel engines, containers for catalysts and for cracking and reformer tubes.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A centrifugally cast cracking and reformer tube, comprising:

a cracking and reformer tube, centrifugally cast from a casting alloy consisting essentially of, in weight percent,

| | |
|---|---|
| at least 0.39 to less than 0.65% | of carbon |
| greater than zero to 1% | of silicon |
| greater than zero to 0.2% | of manganese |
| greater than 25 to 40% | of chromium |
| 0.5 to 13% | of iron |
| 1.5 to 7% | of aluminum |
| at least 0.2 to 2.5% | of niobium |
| greater than zero to 0.18% | of titanium |
| greater than zero to 0.06% | of nitrogen |
| remainder nickel. | |

2. The centrifugally cast cracking and reformer tube of claim 1, wherein the casting alloy further comprises:

| | |
|---|---|
| 0.01 to 0.4% | of zirconium. |

3. The centrifugally cast cracking and reformer tube of claim 1, wherein the casting alloy further comprises:

| | |
|---|---|
| greater than zero to 12% | of cobalt. |

4. The centrifugally cast cracking and reformer tube of claim 1, wherein the casting alloy further comprises:

| | |
|---|---|
| greater than zero to 0.11% | of molybdenum. |

5. The centrifugally cast cracking and reformer tube of claim 1, wherein the casting alloy further comprises:

| | |
|---|---|
| greater than zero to 6% | of tungsten. |

6. The centrifugally cast cracking and reformer tube of claim 1, wherein the casting alloy further comprises:

| | |
|---|---|
| greater than 0 to 0.089% | of yttrium. |

7. The centrifugally cast cracking and reformer tube of claim 6, wherein the casting alloy further comprises:

| | |
|---|---|
| 0.01 to 0.4% | of zirconium |
| greater than zero to 12% | of cobalt |
| greater than zero to 0.11% | of molybdenum; and |
| greater than zero to 6% | of tungsten. |

8. A centrifugally cast cracking and reformer tube, made by a process of:

providing a casting alloy consisting essentially of, in weight percent,

| | |
|---|---|
| at least 0.39 to less than 0.65% | of carbon |
| greater than zero to 1% | of silicon |
| greater than zero to 0.2% | of manganese |
| greater than 25 to 40% | of chromium |
| 0.5 to 13% | of iron |
| 1.5 to 7% | of aluminum |
| at least 0.2 to 2.5% | of niobium |
| greater than zero to 0.18% | of titanium |
| greater than zero to 0.06% | of nitrogen |
| remainder nickel; and | |

centrifugally casting a reformer and cracking tube from the provided casting alloy.

9. The centrifugally cast cracking and reformer tube of claim 8, wherein the casting alloy further comprises:

| | |
|---|---|
| 0.01 to 0.4% | of zirconium. |

10. The centrifugally cast cracking and reformer tube of claim 8, wherein the casting alloy further comprises:

| | |
|---|---|
| greater than zero to 12% | of cobalt. |

11. The centrifugally cast cracking and reformer tube of claim 8, wherein the casting alloy further comprises:

| | |
|---|---|
| greater than zero to 0.11% | of molybdenum. |

12. The centrifugally cast cracking and reformer tube of claim 8, wherein the casting alloy further comprises:

| | |
|---|---|
| greater than zero to 6% | of tungsten. |

13. The centrifugally cast cracking and reformer tube of claim 8, wherein the casting alloy further comprises:

| | |
|---|---|
| greater than 0 to 0.089% | of yttrium. |

14. The centrifugally cast cracking and reformer tube of claim 13, wherein the casting alloy further comprises:

| | |
|---|---|
| 0.01 to 0.4% | of zirconium |
| greater than zero to 12% | of cobalt |
| greater than zero to 0.11% | of molybdenum |
| greater than zero to 6% | of tungsten. |

15. A centrifugally cast cracking and reformer tube, comprising:

a cracking and reformer tube, centrifugally cast from a casting alloy consisting essentially of, in weight percent,

| | |
|---|---|
| at least 0.39 to less than 0.65% | of carbon |
| greater than zero to 1% | of silicon |
| greater than zero to 0.2% | of manganese |
| greater than 25 to 40% | of chromium |
| 0.5 to 13% | of iron |
| 1.5 to 7% | of aluminum |
| at least 0.2 to 2.5% | of niobium |
| greater than zero to 0.18% | of titanium |
| greater than zero to 0.06% | of nitrogen; |
| greater than 0 to 0.089% | of yttrium; and at least one of: |
| 0.01 to 0.4% | of zirconium |
| greater than zero to 12% | of cobalt |

-continued

| | |
|---|---|
| greater than zero to 0.11% | of molybdenum |
| greater than zero to 6% | of tungsten |
| remainder nickel. | |

16. The centrifugally cast cracking and reformer tube of claim 15, wherein the casting alloy comprises:

at least two of:

| | |
|---|---|
| 0.01 to 0.4% | of zirconium |
| greater than zero to 12% | of cobalt |
| greater than zero to 0.11% | of molybdenum |
| greater than zero to 6% | of tungsten. |

17. The centrifugally cast cracking and reformer tube of claim 15, wherein the casting alloy comprises:

at least three of:

| | |
|---|---|
| 0.01 to 0.4% | of zirconium |
| greater than zero to 12% | of cobalt |
| greater than zero to 0.11% | of molybdenum |
| greater than zero to 6% | of tungsten. |

* * * * *